US009050542B2

(12) United States Patent
Clever

(10) Patent No.: US 9,050,542 B2
(45) **Date of Patent: *Jun. 9, 2015**

(54) SLOTTED ROD FOR A CONSTRUCTION TOY

(71) Applicant: Eric Clever, Cherry Hill, NJ (US)

(72) Inventor: Eric Clever, Cherry Hill, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/047,464

(22) Filed: Oct. 7, 2013

(65) Prior Publication Data

US 2014/0099854 A1 Apr. 10, 2014

Related U.S. Application Data

(60) Division of application No. 13/373,954, filed on Dec. 6, 2011, now Pat. No. 8,550,867, which is a continuation-in-part of application No. 12/381,583, filed on Mar. 13, 2009, now Pat. No. 8,070,551.

(51) Int. Cl.
*A63H 33/04* (2006.01)
*A63H 33/08* (2006.01)

(52) U.S. Cl.
CPC ..... *A63H 33/084* (2013.01); *A63H 33/04* (2013.01); *A63H 33/088* (2013.01)

(58) Field of Classification Search
USPC ..... 446/85, 105, 108–128
See application file for complete search history.

(56) References Cited

U.S. PATENT DOCUMENTS

| | | | | |
|---|---|---|---|---|
| 4,334,868 | A | 6/1982 | Levinrad | |
| 5,003,741 | A | 4/1991 | Yeh | |
| 5,199,919 | A | 4/1993 | Glickman | |
| 5,470,139 | A | 11/1995 | Hsiao | |
| 5,647,181 | A | 7/1997 | Hunts | |
| 6,004,182 | A | 12/1999 | Pasin | |
| 7,267,598 | B2 | 9/2007 | Glickman | |
| 8,070,551 | B1 * | 12/2011 | Clever | 446/124 |
| 8,550,867 | B1 * | 10/2013 | Clever | 446/124 |
| 2006/0046604 | A1 | 3/2006 | Scarborough | |

* cited by examiner

*Primary Examiner* — Nini Legesse
(74) *Attorney, Agent, or Firm* — Norman E. Lehrer

(57) ABSTRACT

A slotted rod for a construction toy is comprised of an elongated rod having a body portion with a length that is longer than the thickness. A conventional connector is located at each end of rod for connection to a hub or to another rod for constructing a structure utilizing the construction toy system. The rod includes a plurality of elongated slots arranged around the periphery with each slot extending axially along the length thereof. Each slot is capable of allowing a piece of sheet-like material to pass therethrough. The slots may be formed directly in the body of the rod or in a sleeve that slides over and covers the body portion. In one embodiment, the slot has an opening at one end whereby the sheet-like material can be inserted into the slot by moving it axially into position.

3 Claims, 11 Drawing Sheets

402g
415
414
402h
404c
411
413b
404c 404b
402e
401
413a
417
402f
404b

404a 402c
418
403b
416
402d 406a
408a
405a
402a
403a
408b
406b
405b
402b

SLOTTED ROD FOR A CONSTRUCTION TOY

CROSS-REFERENCE TO RELATED APPLICATIONS

This application is a division of prior patent application Ser. No. 13/373,954, filed Dec. 6, 2011, now U.S. Pat. No. 8,550,867, which application is a continuation-in-part of prior patent application Ser. No. 12/381,583, filed Mar. 13, 2009, now U.S. Pat. No. 8,070,551, which application claims the benefit of U.S. Provisional Patent Application Serial No. 61/036,466, filed Mar. 14, 2008.

BACKGROUND OF THE INVENTION

This invention relates to construction toy systems. More particularly, it relates to improvements in the rods of construction toy systems. With the use of the improved rods of the invention, the construction systems can be used to support or display sheet material or other similar media that may or may nor contain printing or other indicia thereon.

The toy industry is a crowded art with much activity in the construction toy system part of it. There are many U.S. patents, referred to by number below, known to the inventor which have some pertinence. U.S. Pat. No. 1,113,371 discloses an original rod and hub construction toy system with wooden hubs and rods and with the rod inserted into a hole in the hub and held there by friction and compression (interference fit). U.S. Pat. No. 1,707,691 discloses a hub and rod construction toy system with a hub of stamped metal and wooden rods with slit ends. The connection is formed by inserting the metal hub into the rod-end slit.

A great many construction toy systems allow identical elements to be interconnected but with only a few exceptions noted below the actual connections are not genderless. Instead, the male and female connecting elements are placed on opposite ends of the block or hub. U.S. Pat. No. 3,626,632 discloses a typical building block system that allows identical blocks to be interconnected by means of a male element on one side and female elements on three other sides. U.S. Pat. No. 2,800,743 discloses a nearly genderless building block system. But in this system, when genderless connections are made, the elements are no longer aligned and regular figures can not be constructed.

Various concepts from the construction and other industries have been adapted to construction toy systems. U.S. Pat. No. 3,648,404 discloses a hub and rod construction system designed to be used with hollow rods. The construction toy system disclosed in U.S. Pat. Nos. 4,078,328 and 5,049,105 uses a similar connection system. U.S. Pat. No. 3,891,335 discloses a hub and rod and panel snap together construction system. The hub and rod construction toy system disclosed in U.S. Pat. Nos. 5,061,219, 5,137,486 and 5,199,919 uses a retaining clip similar to the one disclosed in U.S. Pat. No. 3,891,335. U.S. Pat. No. 5,137,486 does disclose a genderless hub-hub connection for orthogonally connecting hubs. However, the means of connecting the hubs is not the same means as connecting rods to hubs.

Other mechanical connectors include U.S. Pat. No. 4,280,339, which discloses a torque transfer device for flexible shaft couplings. Each shaft has an extended portion with forked ends defining teeth. The teeth are inserted orthogonally to each other. U.S. Pat. No. 3,800,556 discloses a power shaft coupling including a coupling mechanism having elongate square bars defining extensions. These extensions may be mutually inserted in orthogonal positional relationship. U.S. Pat. No. 2,577,508 is a universal coupling with bifurcated tongues that mate. U.S. Pat. No. 2,832,943 is a detachable coupling in which the male and female members are not identical but do have an orthogonal insert relationship. U.S. Pat. No. 3,224,222 is a universal joint with yoke members including cross-pintles for connecting the yoke members together.

A true genderless system is shown in the present applicant's prior U.S. Pat. Nos. 7,198,537; 6,899,588; 6,422,909 and 6,231,416. In each of those patents, either end of any rod can be connected to any other rod end or to any hub. Similarly, the hubs can be connected to any rod end and to each other.

All of the above-described systems, however, suffer from the same problem. While various structures can be built or assembled, they all will appear to be simply frameworks. There are no rod and hub construction systems known that provide a simple way of closing in the framework or of displaying signs or other indicia. No known systems are designed to hold sheet like material or other media in order to integrate the same into the structure being constructed.

SUMMARY OF THE INVENTION

The present invention is designed to overcome the deficiencies of the prior art discussed above. It is an object of the present invention to provide a rod for use with a toy construction system that can be used in the ordinary manner for building but which allows sheet material to be easily held and displayed.

It is another object of the present invention to provide a rod with a slot therein for holding and supporting the sheet material or similar media.

It is a still further object of the present invention to provide a rod with a slot therein which allows the media to be easily and quickly inserted into or removed as desired.

In accordance with the illustrative embodiments demonstrating features and advantages of the present invention, there is provided a slotted rod for a construction toy which is comprised of an elongated rod member having a body portion with a length that is substantially longer than the thickness. A conventional connector is located at each end of said rod member for connection to a hub member or to another rod member for constructing a structure utilizing the construction toy system. The rod includes a plurality of elongated slots arranged around the periphery with each slot extending axially along the length thereof. Each slot is capable of allowing a piece of sheet-like material or similar media to pass therethrough. The slots may be formed directly in the body portion of the rod member or in a sleeve that slides over and covers the body portion. In one embodiment, the slot has an opening at one end thereof whereby the sheet-like material can be inserted into the slot by moving it axially into position.

Other objects, features, and advantages of the invention will be readily apparent from the following detailed description of a preferred embodiment thereof taken in conjunction with the drawings.

BRIEF DESCRIPTION OF THE DRAWINGS

For the purpose of illustrating the invention, there are shown in the accompanying drawings forms which are presently preferred; it being understood that the invention is not intended to be limited to the precise arrangements and instrumentalities shown.

DESCRIPTION OF THE PREFERRED EMBODIMENTS

Figure 1:
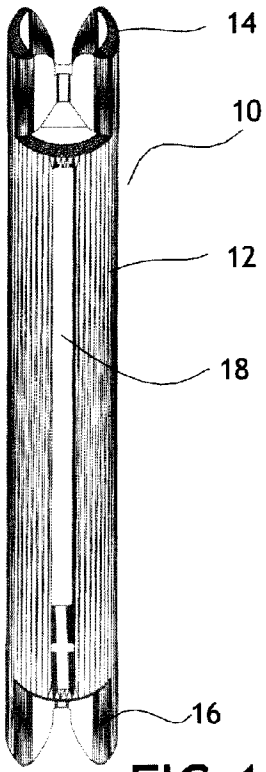
FIG. 1 is a front perspective view of a slotted rod for a construction toy showing one embodiment of my invention.

Referring now to the drawings in detail wherein like numbers have been used throughout the various figures to indicate like elements, there is shown in FIG. 1 a slotted rod for a construction toy designated generally as 10.

The slotted rod 10 includes an elongated rod member having a body portion 12 that has a length dimension extending in an axial direction and also has a thickness dimension as shown in the drawings. As also shown, the length dimension is substantially longer than the thickness dimension. This is, of course, typical of rods used in construction toys.

Connectors 14 and 16 are located at each end of the rod member 12 and are adapted to be connected to another rod member or to a hub member for constructing a structure or the like utilizing the construction toy system. The connectors 14 and 16 are examples of genderless connectors such as described in Applicant's prior patents identified above. It is understood, however, that this is by way of example only. The present invention can be utilized with substantially any types of connectors at the end thereof.

Figure 2:
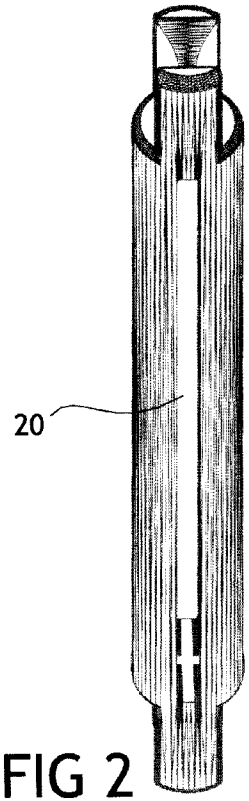
FIG. 2 is a side perspective thereof.

An elongated slot 18 passes entirely through the center of the body portion 12 of the rod member and extends in the axial direction substantially the entire length thereof. As shown in FIG. 2, a second elongated slot 20 which is essentially identical to the elongated slot 18 passes through the center of the rod member 12 at a 90° angle to the slot 18. The two slots 18 and 20, therefore, essentially form a cross through the center of the rod member 12.

In the embodiments shown in FIGS. 1 and 2, there are two slots that pass through the center of the body of the rod member 12. This is also by way of example. It should be readily apparent that fewer or more elongated slots can be formed therein.

Figures 3A, 3B, 3C:
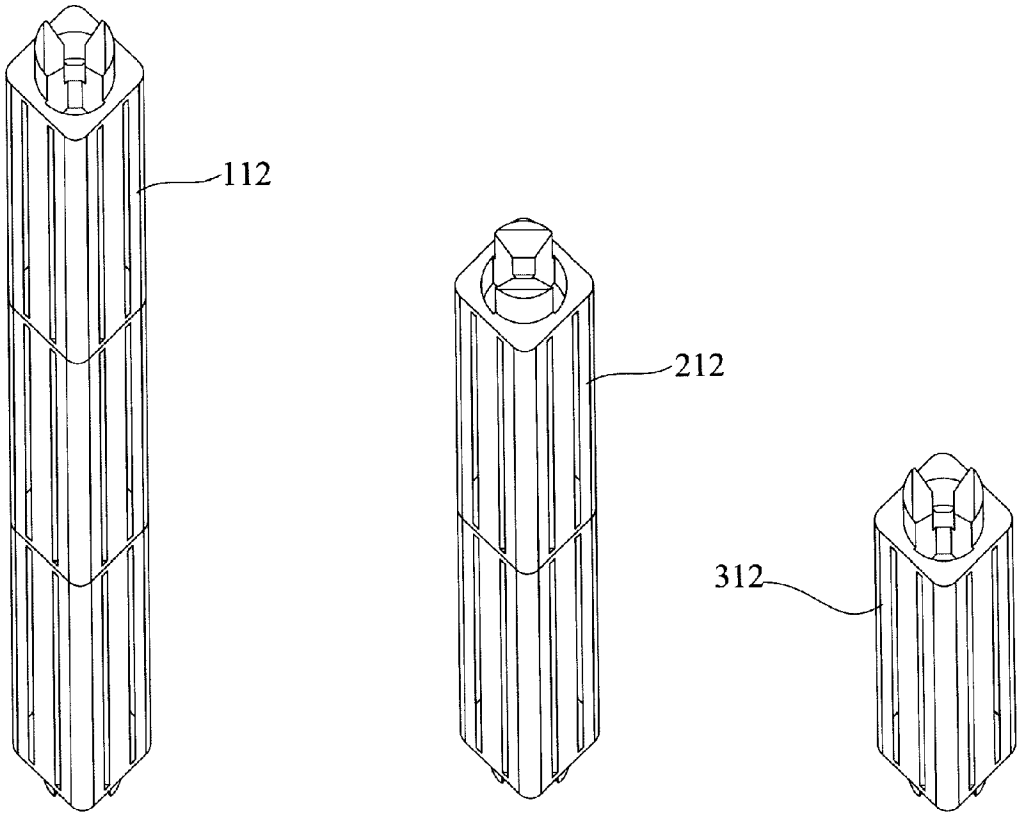
FIGS. 3*a*, 3*b* and 3*c* are elevational views showing variations on the embodiment of FIGS. 1 and 2.

As pointed out above, in the embodiments shown in FIGS. 1 and 2, the elongated slots 18 and 20 extend substantially the entire length of the body of the rod 12. This is also by way of example only. As shown in FIGS. 3*a*, 3*b* and 3*c*, the slots can extend the entire length or only a portion of the length of the rod. In FIG. 3*a*, for example, the rod 112 has slots that extend approximately one-third the length of the rod while FIG. 3*b* shows slots that extend half way through and FIG. 3*c* shows slots running the entire length.

In the embodiments shown in FIGS. 3*a*, 3*b* and 3*c*, it can also be seen that the slots do not run through the center of the body of the rod but only through the peripheral or radial edges of the circumference thereof. Again, the number of slots that are formed in the elongated or axial direction can vary as desired. Certainly, if the rods are very long, it may be desirable to not have the slots run the entire length thereof or the rods may be weakened. However, this is within the scope of the present invention. It is also within the scope of the invention to have a rod that has one or more slots that run the entire length of the rod body and one or more additional slots that extend only part way along the rod body.

Figures 4A, 4B:
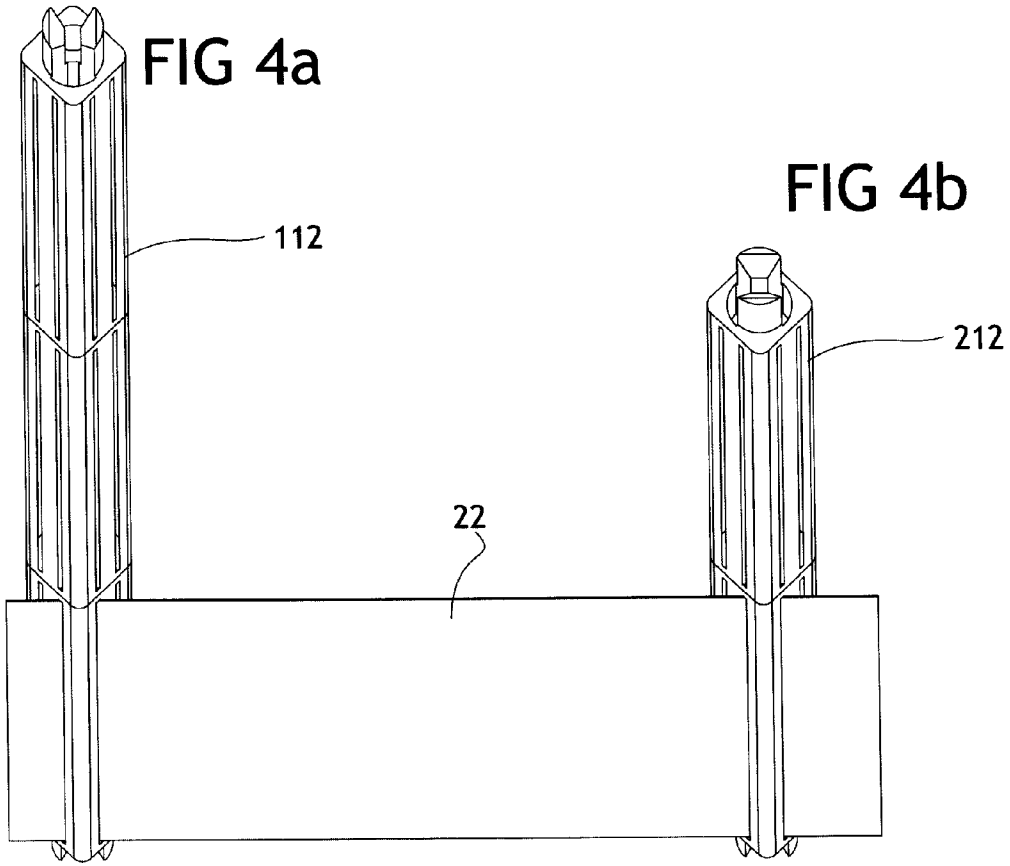
FIGS. 4*a* and 4*b* are perspective view showing how the embodiments of FIGS. 3*a*, 3*b* and 3*c* support sheet-like media.

FIGS. 4*a* and 4*b* are perspective views of the slotted rods of FIGS. 3*a* and 3*b*, respectively, showing in more detail how the slots are formed in the outer peripheral or radial edges of the circumference of the rods. This is preferably done by making the rods of a square or triangular cross section so that the slots can be formed in the corners thereof. Also shown in FIGS. 4*a* and 4*b* is how the sheet-like material or media 22 passes through the slots and is retained therein. The media 22 is preferably of a somewhat flexible nature so that it can be bent slightly, if necessary, to pass the end through the slot.

Figure 5:
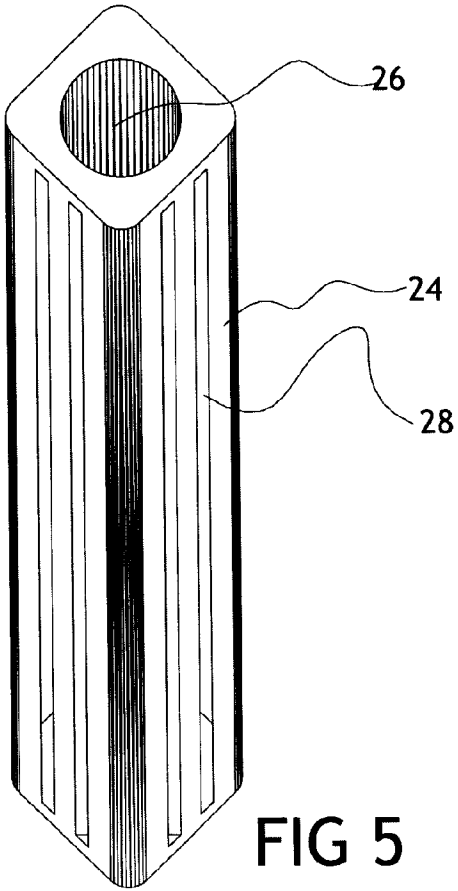
FIG. 5 is a perspective view of a sleeve that represents an additional embodiment of the invention.

In lieu of integrally forming the various slots in the rods as shown in FIGS. 1-4*b*, it is also possible to create sleeves such as shown at 24 in FIG. 5. The sleeve 24 has a central opening 26 which can fit over a slotted rod or over a more standard unslotted rod. In addition, the sleeve 24 can extend substantially the entire length of the body portion of the rod or could cover only a portion thereof. A plurality of slots such as shown at 28 are formed in the outer periphery of the sleeve 24 and resembles the slots as shown in FIGS. 3*a*-4*b*.

Figure 6:
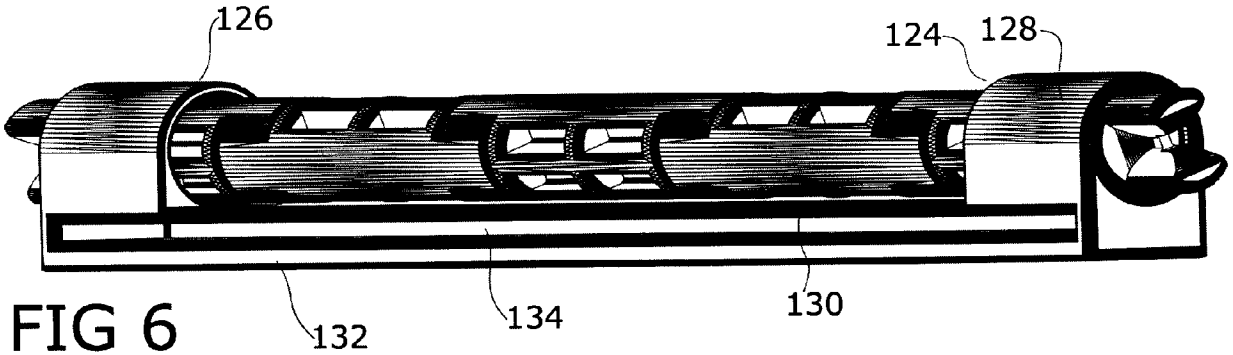
FIG. 6 is a perspective view of another sleeve useful with the present invention.

An alternative form of sleeve 24 is shown at 124 in FIG. 6. In this embodiment, the sleeve is formed of two substantially cylindrical ends 126 and 128 that are connected together by a pair of spaced apart elongated members 130 and 132 which have a slot 134 formed therebetween. As shown in FIG. 6, the sleeve 124 can be placed over a plurality of more conventional rods that are assembled together or could be placed over a single long rod. The media or sheet-like material 22 can pass through the slot 134 in the same manner that it passes through the slots of the rods of the other embodiments described above.

In lieu of passing the end of the sheet-like material 22 through a slot, it is also possible to have the slots formed with an open end so that the sheet material can slide upwardly therethrough. This is shown, for example, in the embodiment of FIG. 7 wherein the sleeve 224 also includes elongated members 230 and 232 that are spaced apart so as to form a slot 234 therebetween but which are not attached together at each end. Rather, an opening 236 is formed at one of the ends of the elongated members 230 and 232 whereby the media 22 can be inserted axially into the slot 234 through the opening 236 and into the slot.

Figure 7:
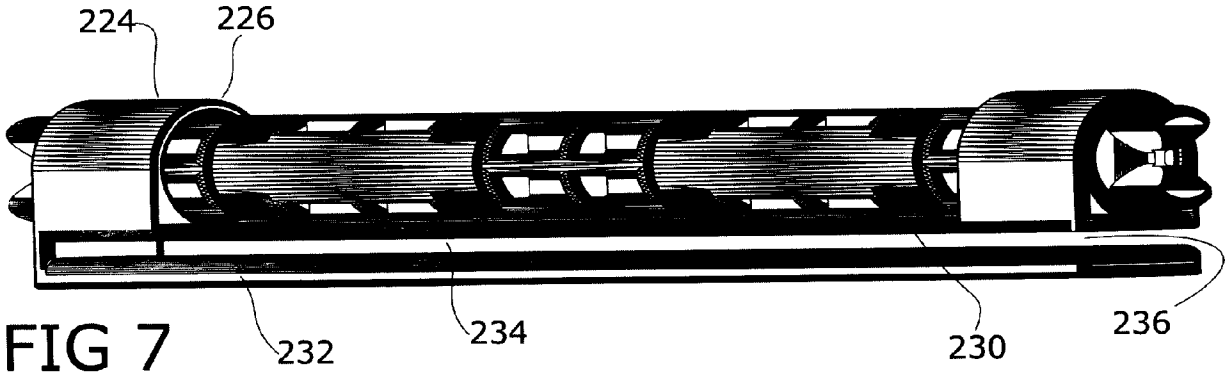
FIG. 7 is a view of a sleeve similar to FIG. 6 but showing a variation thereof.

The opening 236 at the end of the sleeve 224 as shown in FIG. 7 is, of course, by way of example only. It is also possible to have the opening at a position other than the extreme end of the slot. The opening could, for example, be positioned anywhere along the length of the slot and can be formed in the outer elongated member 232. It is preferable, however, that the slot be located adjacent one end for ease of inserting the media 22 therein. Preferably, the slot would also be angled to aid in inserting the media.

In addition, although the opening 236 is shown in the sleeve 224, this is also by way of example only. It should be readily apparent that a similar opening could also be formed in any of the other embodiments shown above. The opening could be formed either in a sleeve to allow entrance into one of the slots or in the rod that has the slots integrally formed therewith.

Figure 8:
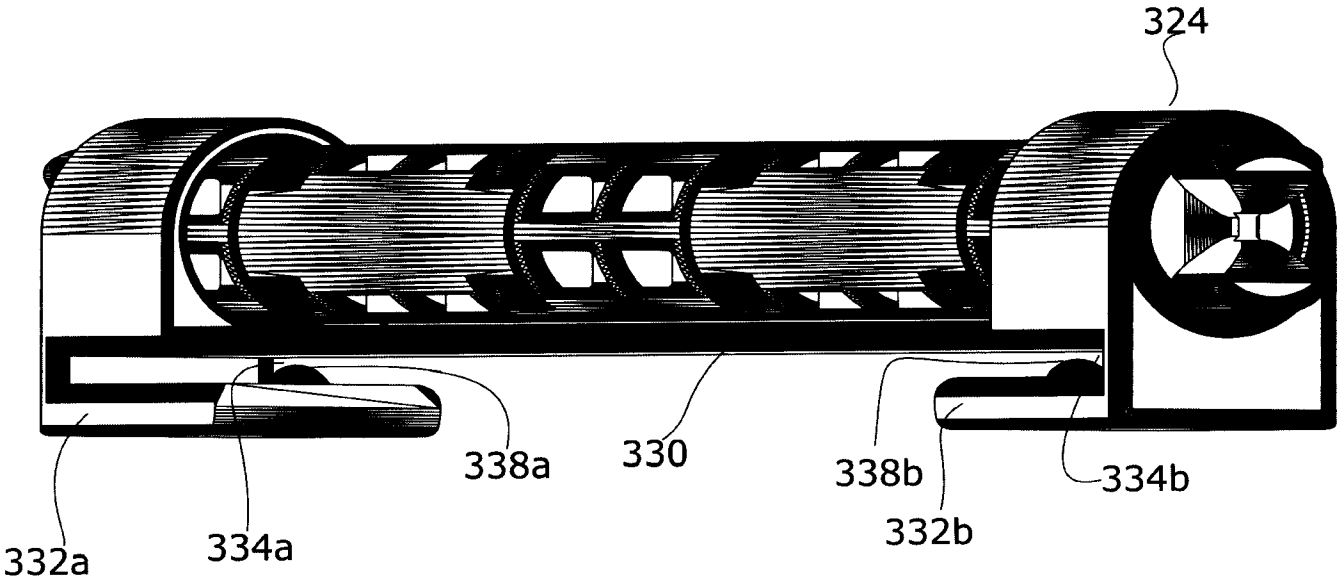
FIG. 8 is another view of a sleeve similar to FIGS. 6 and 7 showing a further variation of the invention.

In some instances, such as when the media has sufficient rigidity, it may not be necessary to have the slot be continuous. For example, in the embodiment shown in FIG. 8, the members 332*a* and 332*b* extend only a portion of the way from their respective ends of the sleeve to form slots 334*a* and 334*b* at the ends of the rods. The slots are created between the members 332*a* and 332*b* and the elongated member 330. As should be readily apparent, two ends of sheet material or media can be held in the two slots 334*a* and 334*b*. Projections 338*a* and 338*b* formed on the inner surfaces of the members 332*a* and 332*b*, respectively, can help to retain the media in place, if necessary.

Figure 9:
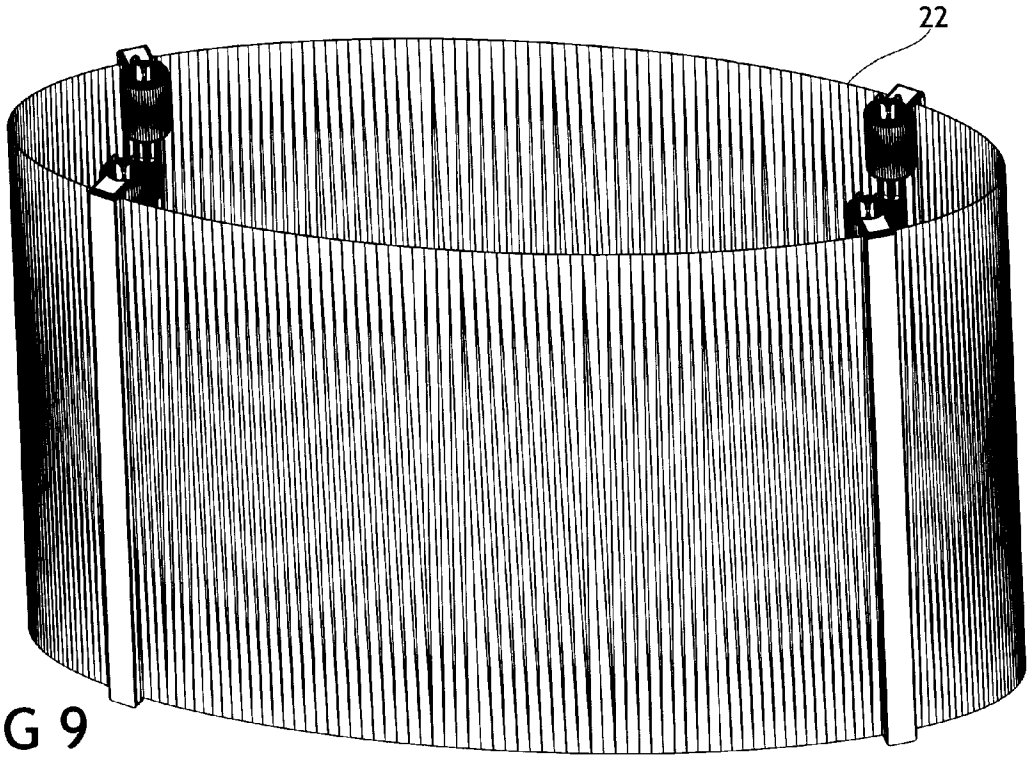
FIG. 9 illustrates how the slotted rods of the invention can be used to support media and build a structure.

The slotted rods of the present invention are used in the conventional manner to build a structure such as shown in FIG. 9. Once the structure is built, however, or as the structure is being built, lengths of sheet-like material or other media 22 can be inserted through the various slots to form internal or external walls or the like for the structure. It is also possible to have indicia formed on the media so that the same can be used to convey information or simply to decorate the same.

An even further variation of the invention is illustrated in FIGS. 10*a* through 10*e*. In lieu of a continuous slot in a rod such as described above, a rod such as shown at 404*a* in FIG. 10*c* can be fitted with a pair of end caps 402*a* and 402*b*. Each of the end caps has an opening therein such as shown at 405*a* and 405*b*, which is adapted to fit over the end of the rod. The end caps can either loosely fit over the rod, can have a friction fit or can otherwise be secured to the rods.

Figures 10A, 10B, 10C, 10D, 10E:
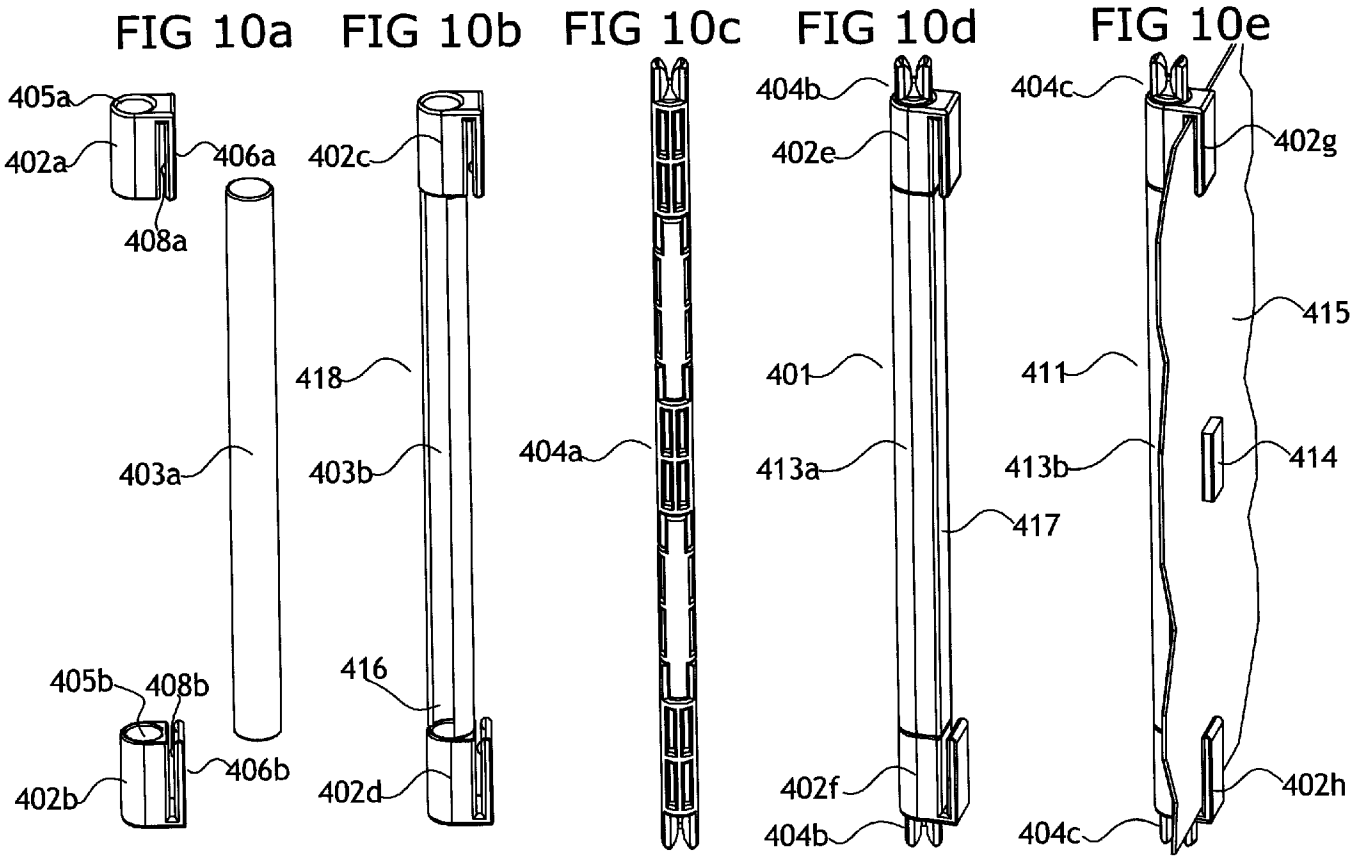
FIGS. 10*a* through 10*e* illustrate a further variation of the present invention.

A spacer 403*a* in the form of a hollow tube can first be fitted over the rod before the end caps are placed thereon. The spacer can either be cylindrical as shown in 403*a* or it can have a flat side 417 as shown in FIGS. 10*d* and 10*e*.

The end caps have a main body portion and an axially extending extension member 406*a* or 406*b* extending from one end thereof and parallel to the main body portion. The extension member 406*a* or 406*b*, however, is spaced slightly from the main body portion to allow media or other sheet material to pass therethrough as shown in FIG. 10*e*. Projections 408*a* and 408*b* are formed on the inner surface of the extensions to help hold the sheet material. Once assembled, the structure just described is similar in function to the embodiment of the invention shown and described in FIG. 8 above.

Either the entire rod 404*a* or the center portion thereof intermediate the two ends can be made of a ferromagnetic material. In this way, once the sheet or media material 415 is held between the two end caps, a small magnet 414 can be used to help retain the same in place.

Figures 11A, 11B, 11C:
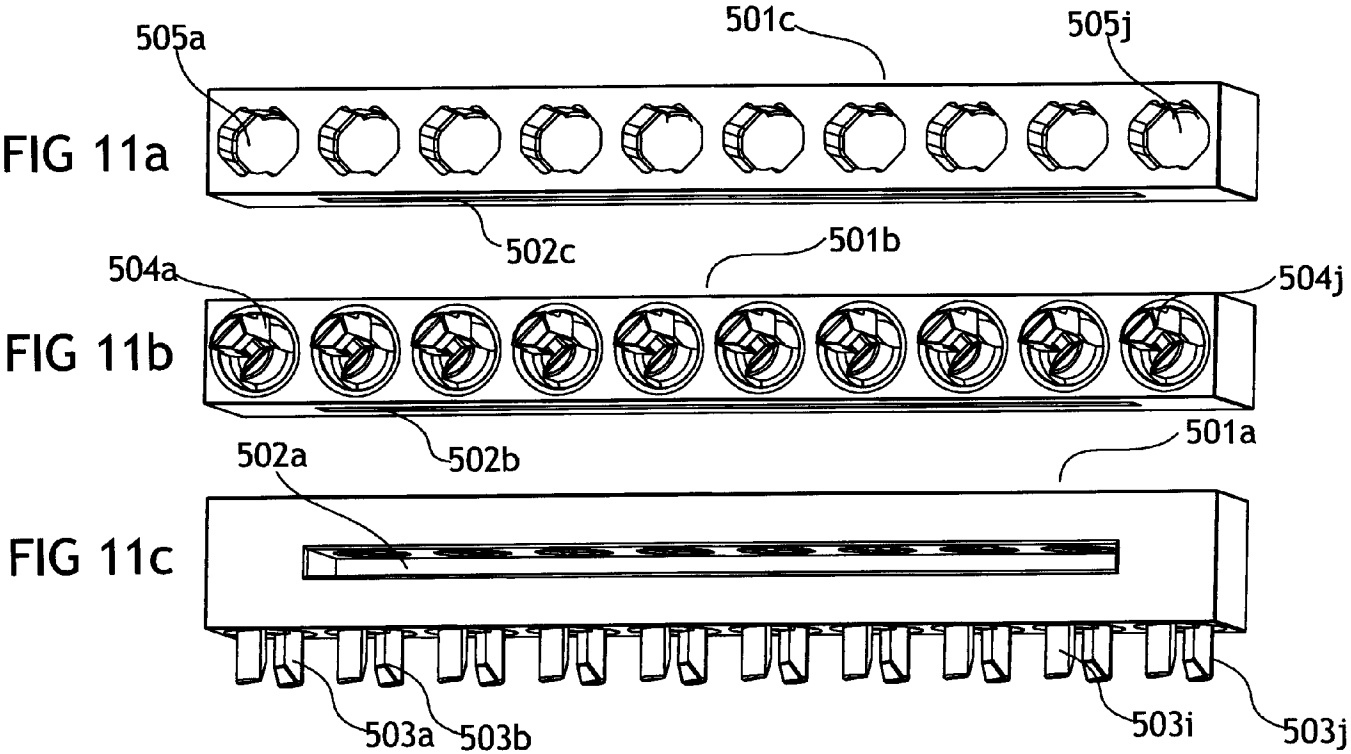
FIGS. 11*a* through 11*c* illustrate a variation of the invention using slotted blocks instead of rods.

FIGS. 11*a*, 11*b* and 11*c* illustrate an invention similar to that described above with respect to FIGS. 1 and 2. However, in lieu of the slot being formed in the rods as shown in those figures, a slot 502 is formed in an elongated hub or block 501. The elongated block has a series of female connectors 505 formed on one side thereof and male connectors 504 formed on the other. As with the rods, the slot 502 passes entirely through the block 501 so that sheet material can pass therethrough.

FIGS. 12*a*-12*d* and 13*a* and 13*b* illustrate another embodiment of the invention that is, in some ways, similar to the embodiment shown in FIG. 10*a*-10*e*. In lieu of the block shown in FIGS. 11*a*-11*c* having a slot therein, hubs or end pieces shown at 701 or 702 can be provided in the form of building blocks. The blocks 701 and 702 can have male connectors 703 extending from one side thereof and female connectors 704 formed on the reverse side. Extending away from the block is a flat extension member 705 or 706. Parallel to the member 705 or 706 but spaced slightly therefrom is another extension member 707 or 708. The space between the members 705 and 707 or between the members 706 and 708 is sufficient to allow a sheet of material such as shown at 711 to be held therein. (See FIG. 13*b*) Projections 709 or 710 can be formed on the inside of the members 705 or 706 in order to help retain the sheet material in place.

Figure 12C:
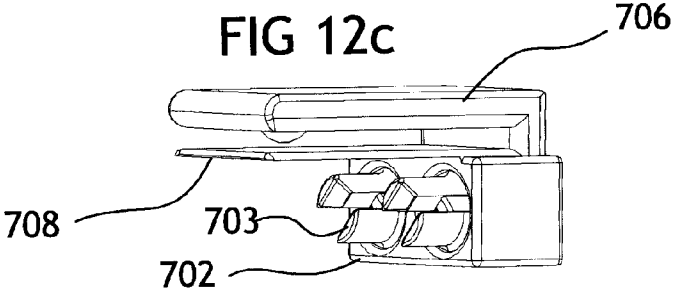
FIGS. 12*a* through 12*d* illustrate additional connectors useful with the present invention.
Figure 12D:
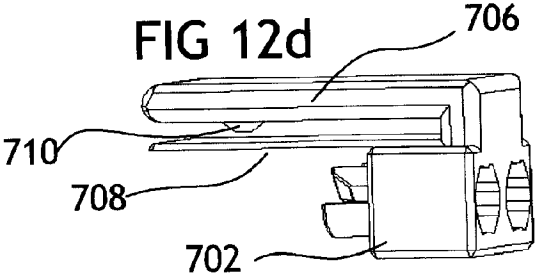
Figure 12A:
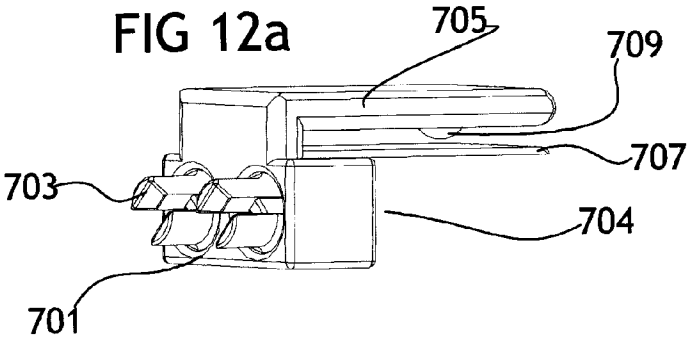
Figure 12B:
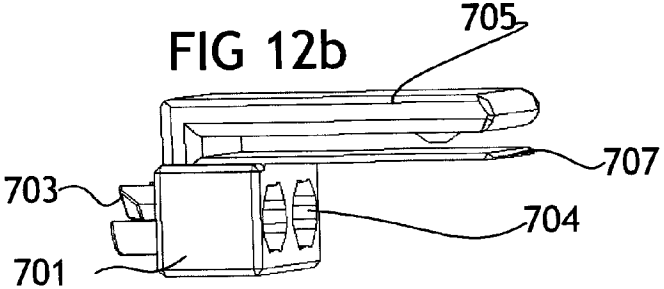
Figure 13B:
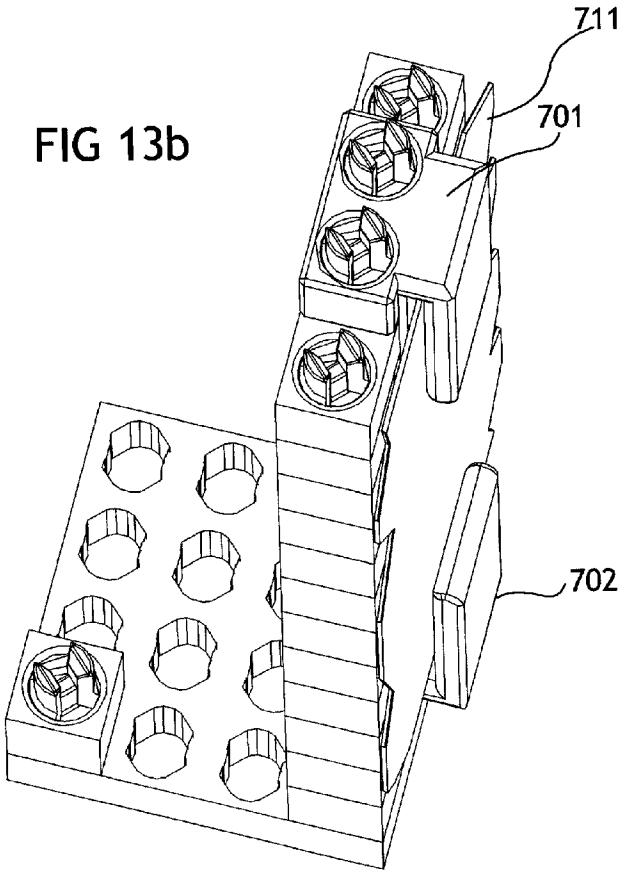
FIGS. 13*a* and 13*b* illustrate the manner in which connectors of FIGS. 12*a* through 12*d* are utilized.
Figure 13A:
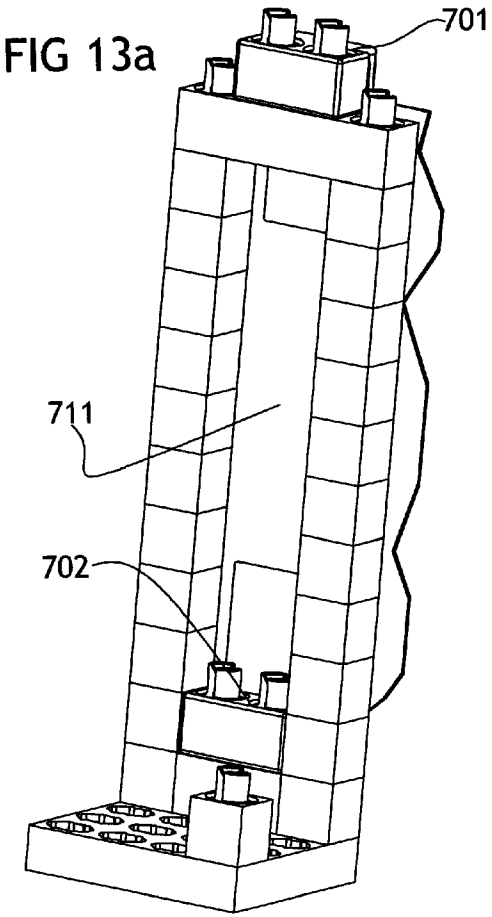

FIG. 13 illustrates how the blocks shown in FIGS. 12*a*-12*c* are utilized. When building a toy structure utilizing Legos or similar building blocks, a block 701 can be placed near the top and the block 702 can be placed near the bottom. The sheet of material 711 can then be held in place in the space between the members 705 and 706.

The present invention may be embodied in other specific forms without departing from the spirit or essential attributes thereof and accordingly reference should be made to the appended claims rather than to the foregoing specification as indicating the scope of the invention.

I claim:

1. A slotted rod for a construction toy comprised of:

an elongated rod member having a body portion that has a length dimension extending in an axial direction and further having a thickness dimension, the length dimension being substantially longer than the thickness dimension;

a connector located at each end of said rod member, each connector being adapted to be connected to a hub member or to another rod member for constructing a structure utilizing said construction toy;

a sleeve member having a length substantially equal to the length of said body portion and which is adapted to slide over and cover at least a portion of said rod member, and a portion of said sleeve member being spaced from said body portion to thereby form a slot extending axially along at least a portion of the length of said rod member, said slot being capable of allowing a piece of sheet-like material to pass entirely therethrough.

2. The slotted rod for a construction toy as claimed in claim 1 wherein said slot extends substantially the entire length of said body portion.

3. The slotted rod for a construction toy as claimed in claim 2 wherein said slot has an opening at an end thereof whereby said sheet-like material can be inserted into said slot by moving it axially into position.

* * * * *